United States Patent [19]

Prete, Jr.

[11] 4,414,713

[45] Nov. 15, 1983

[54] QUICK-RELEASE STRAP BUCKLE

[75] Inventor: Ernest Prete, Jr., Woodland Hills, Calif.

[73] Assignee: Ancra Corporation, El Segundo, Calif.

[21] Appl. No.: 308,428

[22] Filed: Oct. 2, 1981

[51] Int. Cl.[3] ..... A44B 11/00

[52] U.S. Cl. ..... 24/193; 24/197

[58] Field of Search ..... 24/68 E, 168, 170, 164, 24/191, 193, 197, 200, 311, 307

[56] References Cited

U.S. PATENT DOCUMENTS

| | | | |
|---|---|---|---|
| 1,515,412 | 11/1924 | Ritter | 24/197 |
| 1,683,125 | 9/1928 | Brady et al. | 24/193 |
| 3,277,543 | 10/1966 | Gaylord | 24/193 |

FOREIGN PATENT DOCUMENTS

| | | | |
|---|---|---|---|
| 428257 | 8/1911 | France | 24/193 |
| 11726 | of 1891 | United Kingdom | 24/193 |

*Primary Examiner*—Robert P. Swiatek

*Attorney, Agent, or Firm*—Edward A. Sokolski

[57] ABSTRACT

A quick-release buckle of economical construction for use in situations where rapid release of a strap is required, such as, for example, a buckle for a strap holding a scuba air tank to a backpack. The buckle has a main body portion which has a pair of oppositely positioned similar side walls with a pair of spaced apart cross bars or arms running therebetween. An operating handle for use in retaining the strap to the main body portion and releasing it therefrom is pivotally supported between the side members of the main body of the buckle. The operating handle as a pair of side arms which are connected together by a cross arm, the side arms being pivotally retained in apertures formed in the side plates of the main body portion of the buckle. A pair of detents are formed along the outer walls of the side plates of the main body portion, with the side arms of the operating handle being resiliently separable such that the operating lever can be moved past the detents and latched in position between the detents and stop members formed in the side plates, thereby retaining the strap in a secured position.

5 Claims, 6 Drawing Figures

QUICK-RELEASE STRAP BUCKLE

This invention relates to strap buckles, and more particularly to such a buckle which is rapidly releasable and which employs detents and stop members for retaining an operating handle in its closed position.

In retaining a scuba tank or the like to a backpack, secure retention of the tank is required, while at the same time it is desirable that the tank be rapidly releasable from the backpack, both in emergency situations and where the tank is to be serviced or refilled with air. Prior art fastening devices tend to be overly expensive and complicated in their construction and are not releasable as readily as would be desired. The buckle of the present invention overcomes the aforementioned shortcomings of the prior art in providing a very simple, economical and rapidly and easily operated buckle which can be used for retaining a scuba tank to a backpack or for other purposes.

Briefly described, the device of the present invention comprises a main body portion having a pair of side plates which are joined together by cross arms or bars, these cross arms being spaced apart from each other such that a slot is formed therebetween. A pair of oppositely positioned detents is formed on the outer walls of the side plates as are a pair of stop members, a space for latching the side arms of an operating handle being formed between the detents and the stop members.

The operating handle is made of a resilient high-strength material, such as steel, having a pair of side arms joined together by a cross arm, and is pivotally mounted in apertures formed in the oppositely positioned side walls. One end of the strap is fixedly attached to one of the cross arm members of the main body portion, while the other, "free" end of the strap is fed up through the slot between the cross arms, thence around the cross arm of the operating handle, and then out through the slot underneath the other of the cross arms. The operating lever is brought to the closed strap-retaining position by moving the lever over the detents until the side arms thereof snap in position between the detents and the stop members.

It is therefore an object of this invention to provide an economical buckle member of simple construction which is capable of rapid release.

It is still another object of this invention to provide an improved buckle member for use in attaching a scuba tank to a backpack which has firm retentive capabilities, yet which can be readily and easily released.

Other objects of the invention will become apparent as the description proceeds in connection with the accompanying drawings of which:

Figure 1:
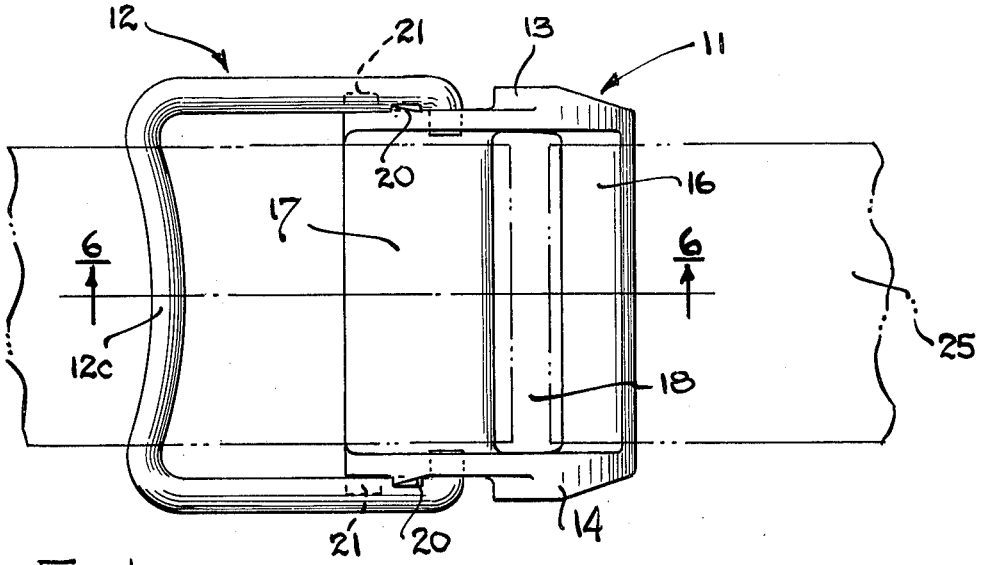
FIG. 1 is a top plan view illustrating a preferred embodiment of the invention with a strap attached thereto.
Figure 2:
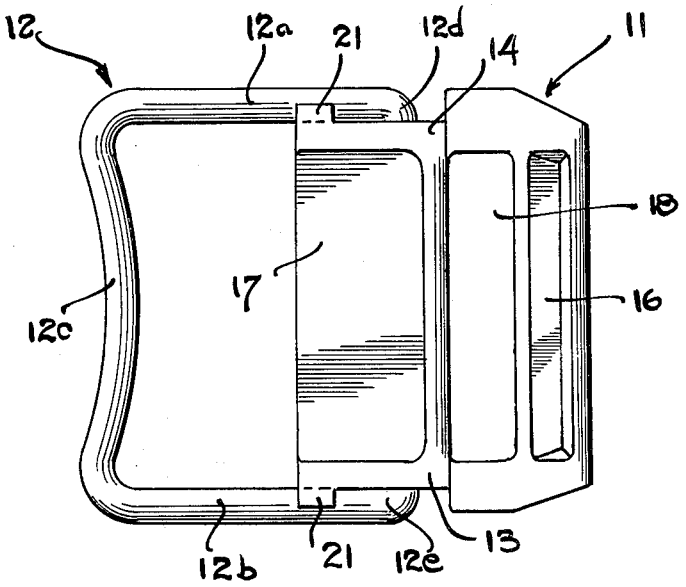
FIG. 2 is a bottom plan view of the preferred embodiment without the strap attached thereto.
Figure 3:
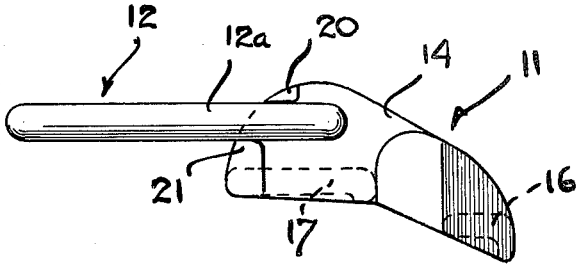
FIG. 3 is a side elevational view of the embodiment of FIG. 2.
Figure 4:
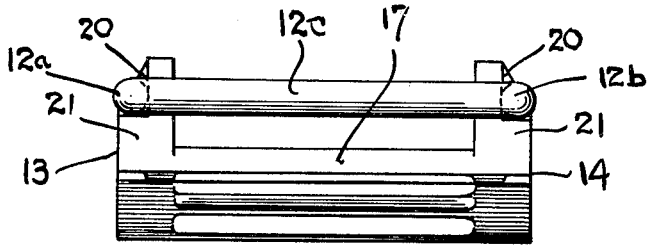
FIG. 4 is a front elevational view of the preferred embodiment of the invention.
Figure 5:
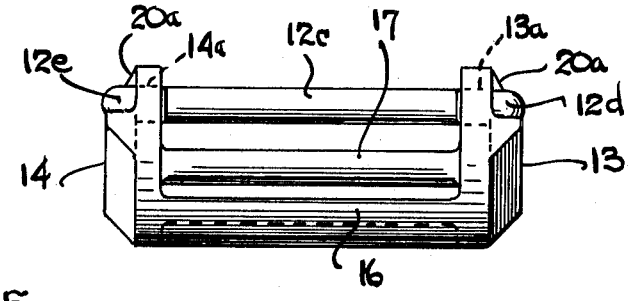
FIG. 5 is a rear elevational view of the preferred embodiment.

Referring now to FIGS. 2–5, a preferred embodiment of the buckle of the invention is illustrated. The buckle includes a main body portion 11 which may be integrally formed of a material such as a suitable plastic and an operating handle 12 which is preferably formed from a resilient, high-strength material such as steel. Main body portion 11 has a pair of oppositely positioned side walls 13 and 14 which have a rear cross arm 16 and a front cross arm 17 running therebetween. Cross arms 16 and 17 are substantially flat and are separated from each other by a space which forms a slot 18 therebetween. Front cross arm 17 is substantially wider than rear cross arm 16.

Operating handle 12 is fabricated of an elastic material such as steel and has a pair of side arms **12*a* and 12*b* and an arcuate cross arm 12*c* which joins the side arms together. Side arms 12*a* and 12*b* have turned-in end portions 12*d* and 12*e* respectively, which snap into apertures 13*a* and 14*a* respectively formed in side walls 13 and 14. A wedge-shaped detent 20 is formed along the top edge of each of side walls 13 and 14. Also formed on each of side walls 13 and 14 directly below each detent is a stop member 21. In its closed position as shown in the figures, the side arms 12*a* and 12*b* of handle 12 are retained in position between detents 20 and stop members 21. The handle snaps into this position when lowered from its upward position by virtue of the side arms thereof riding over the detents 20, these arms being slightly sprung out of their retaining apertures 13*a* and 14*a* as they ride over the detents. The detents 20 have top surfaces 20*a*** which slope inwardly towards the edges of the side walls to facilitate the movement of the handle side arms thereover in the downward travel of the handle.

Figure 6:
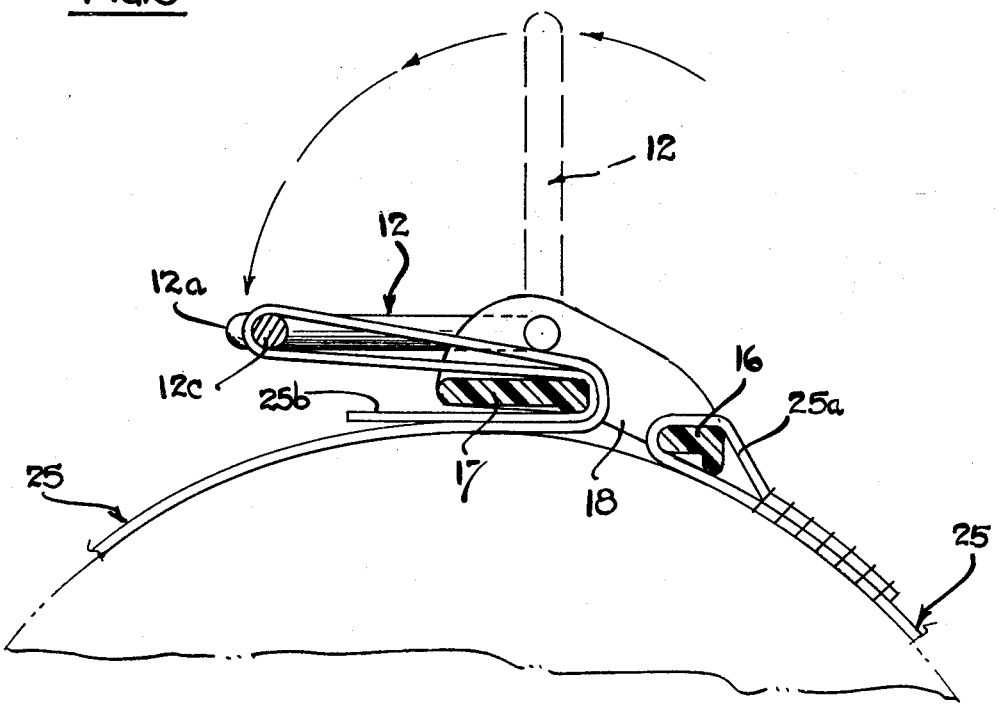
FIG. 6 is a cross-sectional view taken along the plane indicated by 6—6 in FIG. 1 which illustrates the use of the device of the invention for retaining a scuba tank to a backpack.

The operation of the device of the invention is illustrated in connection with FIGS. 1 and 6 are being employed to retain a scuba air tank to a backpack by means of a strap 25. One end **25*a* of the strap is wound around cross arm 16 and stitched permanently in this position. The other end 25*b* of the strap is run upwardly through slot 18 and then wound around cross arm 12*c* of the operating handle, and finally around cross arm 17 in a direction away from slot 18 so that the entry portion of the strap is lapped against the end portion thereof. Thus, when the operating lever 12 is moved from its open position, as shown by the dashed lines in FIG. 6, to its closed position, the side arms 12*a* and 12*b* slide over detents 20 at which time, as already noted, the turned-in end portions 12*d* and 12*e* thereof are sprung slightly out of their associated retaining apertures in the side walls, and finally the handle comes to rest with the side arms thereof snapped in position between detents 20 and stop members 21. Thus, the operating lever is firmly retained between detents 20 and stop members 21 and in this position firmly holds the strap in position. The strap can be readily and rapidly released merely by exerting a positive upward lifting force thereon. With the lever in the upward position as indicated by the dashed lines, the end 25*b*** of the strap can be easily released therefrom or initially adjusted to a desired tightened position.

It is to be noted that the buckle of the invention can be implemented using only a single detent 20 operating in conjunction with a single stop member 21 formed on only one of the side walls. Further, while described for operating in conjunction with a continuous strap for retaining a cylindrical member in place, it could also be used for joining two straps together in a straight line configuration.

While the invention has been illustrated and described in detail, it is to be clearly understood that this is intended by way of illustration and example only and is not to be taken by way of limitation, the spirit and scope of this invention being limited only by the terms of the following claims.

I claim:

1. A quick-release buckle for joining strap together comprising (1) a main body portion including (a) a pair of oppositely positioned side walls (b) first and second spaced apart cross arms running between said side walls, (c) a slot being formed between said cross arms, (d) a detent formed along the upper portion of the outer surface of at least one of said side walls, and (e) a stop member formed below said detent on the other surfaces of said at least one of said side walls, (f) an aperture formed in the outer surface of each of said side walls; and (2) a handle of an elastic material including (a) a pair of side arms, (b) a cross arm joining one of the ends of said side arms together, (c) the other of the ends of the side arms having turned-in end portions, said turned-in end portions being fitted in the apertures formed on the side walls of the main body portion such that the side arms extend partially along the outside of the main body portion;

the handle being movable from an "open" to a "closed" position, during which movement at least one of the side arms of the handle rides over the detent and slightly springs the turned-in end portion thereof out of its associated aperture, said at least one of said side arms finally snapping into a retained position between the detent and the stop member.

2. A quick-release buckle comprising (1) a main body portion including (a) a pair of oppositely positioned side walls, (b) first and second spaced apart cross arms running between said side walls, (c) a slot being formed between said cross arms, (d) detents formed along the top edge of the outer surfaces of each of said side walls, and (e) stop members formed directly below each of said detents on the outer surfaces of each of said side walls, (f) an aperture formed in the outer surface of each of said side walls;

(2) a handle of an elastic material including (a) a pair of side arms, (b) a cross arm joining one of the ends of said side arms together, (c) the other of the ends of the side arms having turned-in portions, said turned-in end portions being fitted in the apertures formed on the side walls of the main body portion such that the side arms extend partially along the outside of the main body portion; and (3) a strap, one end of said strap being fixedly attached to the first of the cross arms of said main body portion, the other end of said strap being fed up through the slot formed between said cross arms of said main body portion, wrapped around the of the handle and down through said slot;

the handle being movable from an "open" to a "closed" position, during which movement the side arms of the handle ride over the detents and slightly spring the turned-in end portions thereof out of their associated apertures, the side arms finally snapping into a retained position between the detents and the stop members.

3. The buckle of claim 1 or 2 wherein the detents are wedge shaped and have top surfaces which slope inwardly towards the edges of the side walls to facilitate the movement of the handle side arms thereover.

4. The buckle of claim 1 or 2 wherein the main body portion cross arms are substantially flat, the second of the cross arms being substantially wider than the first of the cross arms.

5. The buckle of claim 1 or 2 wherein the cross arm of the operating handle is arcuate and is curved inwardly.

* * * * *